US007418748B2

(12) United States Patent
Lamke

(10) Patent No.: US 7,418,748 B2
(45) Date of Patent: Sep. 2, 2008

(54) SLEEPING BAG WITH REPLACEABLE AIR MATTRESS

(75) Inventor: Samuel F. Lamke, Washington, MO (US)

(73) Assignee: North Pole Limited, Kowloon (HK)

( * ) Notice: Subject to any disclaimer, the term of this patent is extended or adjusted under 35 U.S.C. 154(b) by 0 days.

(21) Appl. No.: 10/735,032

(22) Filed: Dec. 12, 2003

(65) Prior Publication Data

US 2004/0123385 A1 Jul. 1, 2004

Related U.S. Application Data

(63) Continuation of application No. 09/972,212, filed on Oct. 4, 2001, now Pat. No. 6,675,414.

(51) Int. Cl.
*A47G 9/08* (2006.01)

(52) U.S. Cl. ..... 5/413 AM

(58) Field of Classification Search ..... 5/413 AM, 5/413 R, 706, 710

See application file for complete search history.

(56) References Cited

U.S. PATENT DOCUMENTS 867,464 A * 10/1907 Abbot ..... 5/413 R
1,648,373 A * 11/1927 Vilas ..... 5/413 R
4,862,533 A * 9/1989 Adams, III ..... 5/413 R
5,005,236 A * 4/1991 Hutchinson ..... 5/413 AM
5,471,687 A * 12/1995 Vierra ..... 5/413 AM
5,528,779 A * 6/1996 Lee et al. ..... 5/413 AM
5,553,339 A * 9/1996 Thomas ..... 5/413 AM
5,560,056 A 10/1996 Tai
5,640,725 A * 6/1997 Ando et al. ..... 5/413 AM
6,675,414 B2 1/2004 Lamke
2002/0104162 A1 8/2002 Stewart

* cited by examiner

*Primary Examiner*—Alexander Grosz
(74) *Attorney, Agent, or Firm*—Armstrong Teasdale LLP

(57) ABSTRACT

A sleeping structure includes a sleeping bag having a top layer having a top layer opening edge and a top layer sealed edge, and a bottom layer having a bottom layer opening edge and a bottom layer sealed edge. A first fastener releasably fastens the top layer opening edge and the bottom layer opening edge at a first attachment site. An enclosure bag is releasably coupled to the bottom layer and defines a mouth. An air mattress having a perimeter and including an inflatable portion is removably inserted into the mouth.

4 Claims, 4 Drawing Sheets

SLEEPING BAG WITH REPLACEABLE AIR MATTRESS

This application is a continuation of U.S. application Ser. No. 09/972,212 filed Oct. 4, 2001, now U.S. Pat. No. 6,675,414, and claiming priority from U.S. Provisional Application Ser. No. 60/238,660 filed Oct. 4, 2000, all applications incorporated herein by reference and all priorities claimed.

TECHNICAL FIELD

The present invention relates generally to camping equipment and more particularly to sleeping bags with integral air mattresses.

BACKGROUND ART

Millions of people worldwide go camping each year to experience the outdoors away from the comforts of city life. Although part of the attraction of camping is "roughing it", there is a certain minimal level of comfort which many people like to maintain in order to have a pleasant experience. Sleeping is one activity which is hard to perform well without such a minimal comfort level. The surface upon which a camper sleeps can be very important in determining the level of comfort. In order to isolate the sleeper from the hardness and irregularities of the ground, it has become the practice of many campers to use an air mattress, which is basically a thick flat rubber balloon which can be interposed between the sleeper's sleeping bag and the ground.

There may be certain problems associated with using a sleeping bag with a separate air mattress. As a sleeping person turns in his sleep, the bag, which may be made of nylon or some other somewhat slippery material, may tend to slide off of the air mattress. In response to these problems there have been attempts to make a sleeping bag with an integral air mattress, so that they will not separate during sleep-time movements. However, there may be additional problems with sleeping bag which has an air mattress permanently attached. As with all balloon-like structures, punctures are a danger. Although an air mattress may be patched to repair punctures, there may come a time when further repair is not worth the effort, and it is desirable to replace the mattress. For mattresses which are integrally formed, or permanently attached, replacement may be difficult without destroying the overall equipment.

Also there may situations, where a removable air mattress would be desirable from a weight standpoint, or for use in cabins, where the bag is useful as a blanket, but an air-cushion is not necessary.

Thus there is a need for a sleeping bag which includes an attachable air mattress, but which has an air mattress which is easily detachable, and replaceable in case of damage, or when an air-cushion feature is not desired.

DISCLOSURE OF INVENTION

Accordingly, it is an object of the present invention to provide a sleeping bag with attached air mattress.

Another object of the invention is to provide an air mattress which is detachable from the sleeping bag.

And another object of the invention is to provide an air mattress which is replaceable by another of its kind when desired.

Briefly, one preferred embodiment of the present invention is a sleeping bag with a replaceable air mattress, where the sleeping bag includes a top layer and a bottom layer. The top layer has a top layer opening edge and a top layer sealed edge, and the bottom layer has a bottom layer opening edge and a bottom layer sealed edge. The top layer opening edge and the bottom layer opening edge are releasably fastened along some portion of their length by a first fastener which is attached at a first attachment site. The bottom layer further includes a second attachment site for an upper portion of a second fastener. The air mattress has a perimeter and includes an inflatable portion and a peripheral extension. The peripheral extension includes a third attachment site for a lower portion of a second fastener. Upper and lower portions of the second fastener releasably fasten the air mattress to the sleeping bag.

An advantage of the present invention is that the sleeping bag may not require padding and heat insulation on its lower surface, as the air mattress may provide padding and heat insulation.

A further advantage is that in standard manufacturing practice for air mattresses, a bordering strip of material is included beyond the inflation area of the air mattress, and this bordering strip is usually trimmed off. However, this same bordering strip may be used as an attachment site for detachably fastening the air mattress to the sleeping bag, and thus eliminating a fabrication step.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
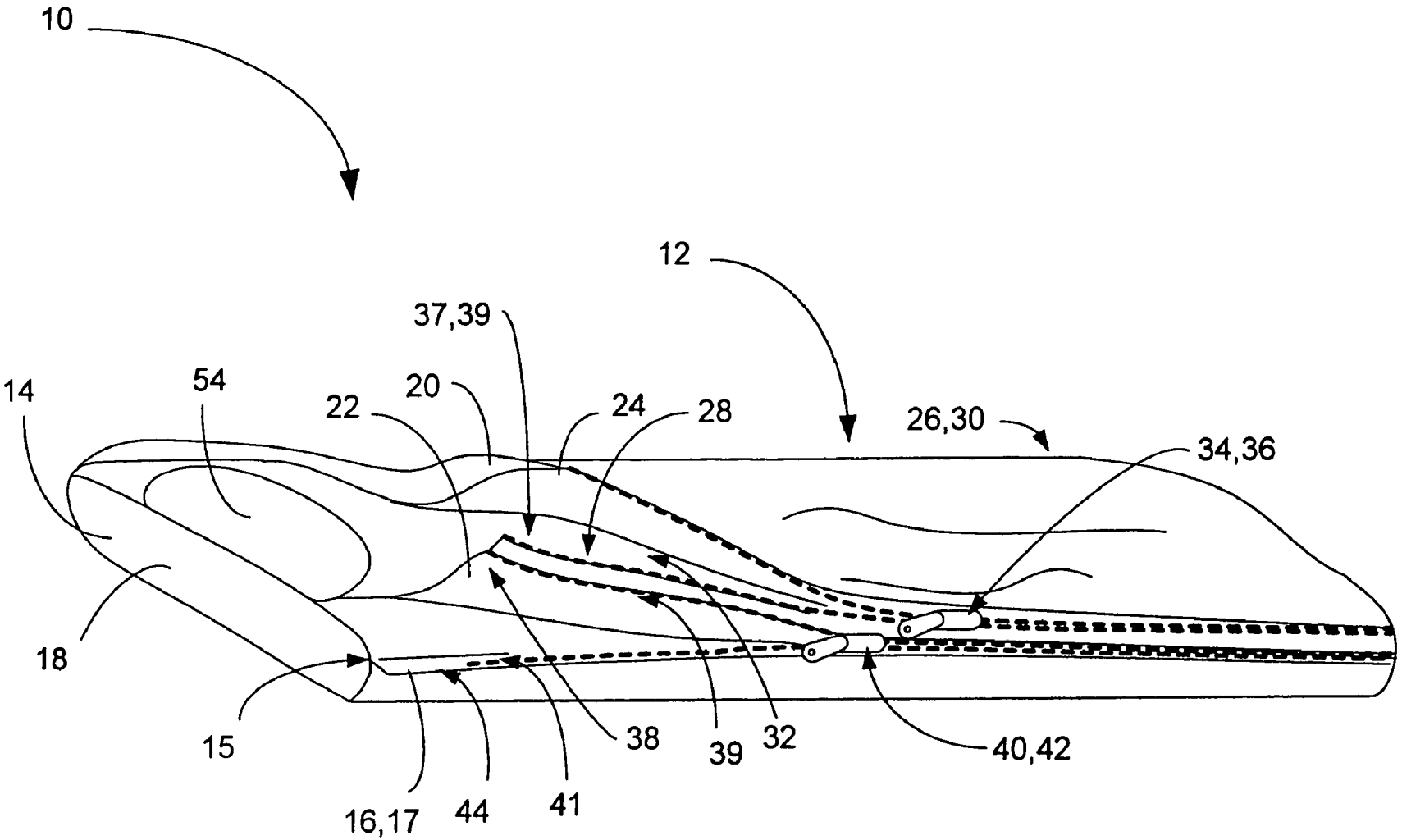
FIG. 1 shows a front isometric view of a first preferred embodiment of the sleeping bag with replaceable air mattress of the present invention.

A preferred embodiment of the present invention is a sleeping bag with replaceable air mattress. As illustrated in the various drawings herein, and particularly in the view of FIG. 1, a form of this preferred embodiment of the inventive device is depicted by the general reference character 10.

FIG. 1 illustrates a sleeping bag with replaceable air mattress 10, which generally includes a sleeping bag 12 and an air mattress 14 having a perimeter 15 around an inflatable portion 18, this inflatable portion being defined as an enclosure which is sealable to contain pressurized air. The perimeter 15 has a peripheral extension 16 around portions of at least two sides of the inflatable portion 18. The peripheral extension 16 is preferably not designed to contain pressurized air, and is, in this preferred embodiment, a flat flap, or flange 17, which may be some of the residual material, sometimes referred to as "flash", left over from the manufacturing process. During fabrication, an air mattress is usually formed by taking two sheets of material, and heat-sealing an air-tight seam surrounding the inflatable portion. It is generally impractical to have the seam located precisely at the edge of the sheets of material, since minor misplacement or mis-alignment of either sheet can mean that the seam is improperly fashioned and thus an air-leak can occur. In order to avoid this, the seam is usually located inwardly from the edges, thus leaving a residue of flash or a flange which is then generally trimmed off. The present invention 10 makes use of this flange 17, avoiding the step of trimming, and thus simplifying manufacture.

The sleeping bag 12 includes a top layer 20, which preferably includes thermal material which retains body heat well, such as batting, down, polyester fill material, etc. in the manner of conventional sleeping bags. Beneath this is a bottom layer 22, which may include thermal material as well, but in this preferred embodiment does not, since the attached air mattress 14 will provide thermal insulation from the ground. It is thus possible to reduce the weight of the overall sleeping bag 10 by the weight of the omitted thermal layer which would otherwise be used in the bottom layer 22. The top layer 20 has an opening edge 24 and a sealed edge 26, and the bottom layer 22 also has an opening edge 28 and a sealed edge 30. The opening edges 24, 28, as the name implies, include an entry opening 32 through which the user enters when he is to use the sleeping bag 12. The opening edges 24, 28 therefore include portions of a first fastener 34, in this preferred embodiment, a first zipper 36, which closes the opening 32, by sealing together the opening edges 24, 28. The opening edge 28 of the bottom layer 22 thus includes a first attachment site 37 for the lower portion 35 of the first fastener 34, and additionally includes a second attachment site 38 for the upper portion 39 of a second fastener 40, in this case a second zipper 42. The peripheral extension 16 or flange 17 includes a third attachment site 44 for the lower portion 41 of the second fastener 40. The upper portion 39 and lower portion 41 of the second fastener 40 thus attach the bottom layer 22 opening edge 28 to the flange 17 of the air mattress 14. The first and second fasteners 34, 40 can be any of a number of conventional fasteners such as Velcro®, hook and eye fasteners, snaps, etc. As referred to above, a major advantage of this invention is that in standard manufacturing practice for air mattresses, a bordering strip of material is included beyond the inflation area of the air mattress, and this bordering strip is usually trimmed off. However, for the present invention 10, this same bordering strip, denoted here as the peripheral extension 16 or flange 17, may be used as the third attachment site 44 for detachably fastening the air mattress 14 to the sleeping bag 12, and thus eliminating a fabrication step.

Figure 2:
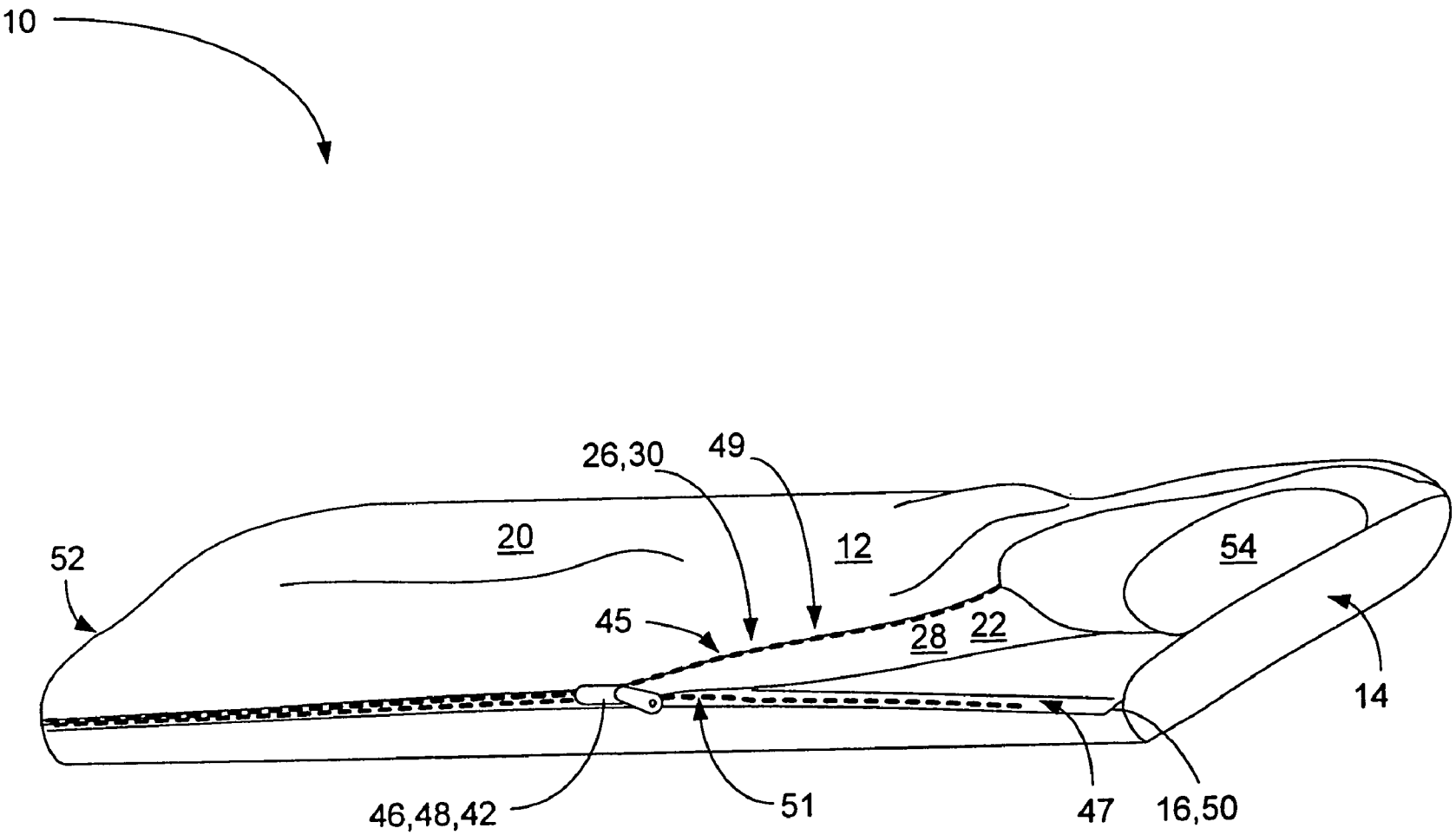
FIG. 2 shows a rear isometric view of a first preferred embodiment of the sleeping bag with replaceable air mattress of the present invention.

FIG. 2 illustrates the sleeping bag with air mattress 10 as seen from the opposite side. The sealed edges 26, 30 of the top layer 20 and bottom layer 22 are shown as being permanently sealed together. The sealed edge 26, 30 of either the top layer 20 or the bottom layer 22, includes a fourth attachment site 45 for an upper portion 49 of a third fastener 46, in this case a third zipper 48. The second portion 50 of the peripheral extension 16 or flange 17 includes a fifth attachment site 47 for the lower portion 51 of the third fastener 46. The upper portion 49 and lower portion 51 of the third fastener 46 thus attach the sealed edge 26, 30 to the second portion 50 of the peripheral extension 16 or flange 17 of the air mattress 14.

It is possible that the second peripheral extension portion 50 is actually a continuation of the peripheral extension 16 seen in the previous figure, which has followed the perimeter 15 of the air mattress 14 around to this side. It is also possible that the second zipper 42 and the third zipper 48 are also continuous, and merely portions of a single zipper that extends around one side, across the foot 52 of the sleeping bag 12 and up the other side.

Thus the second zipper 42 and the third zipper 48, (or the second zipper 42 alone, if it is continuous to the second peripheral extension portion 50), can be unzipped to detach the air mattress 14 from the sleeping bag 12 whenever it is desired to replace the air mattress because of leaks. It may also be removed in situations where an air mattress is not required, as when the sleeping bag is being used more as a blanket, and bottom thermal isolation and cushion support are not necessary.

The sleeping bag with replaceable air mattress 10 may also include an optional pillow 54 which could be fabricated as either a part of the sleeping bag 12, or as part of the air mattress 14.

Figures 3A, 3B, 3C:
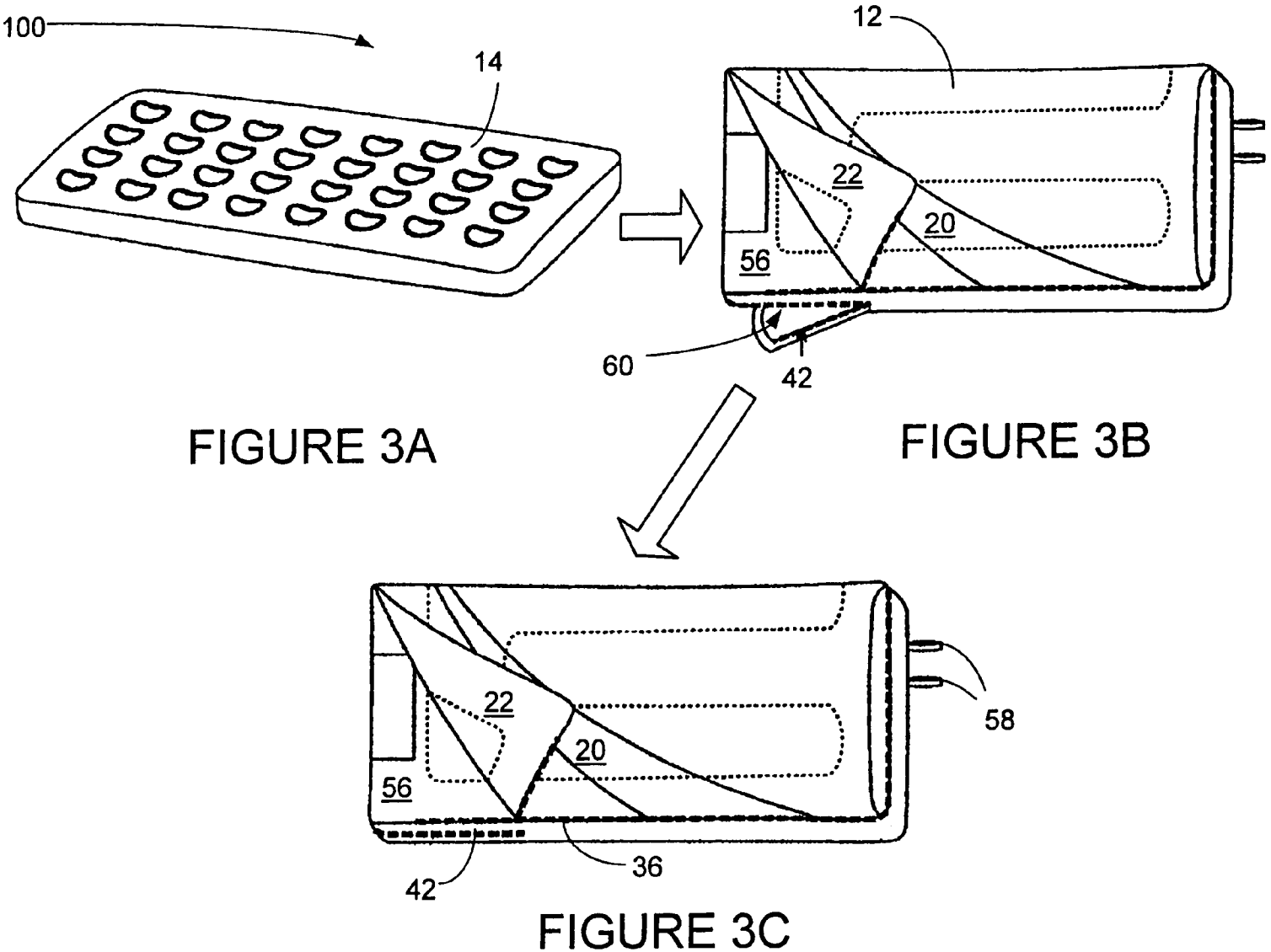
FIGS. 3A-C show isometric views of the assembly of a second preferred embodiment of the present invention.

FIGS. 3A-C illustrate a second preferred embodiment 100 in which the air mattress 14 is removable from an enclosure bag 56. In this case, the enclosure bag 56 may be permanently attached to the sleeping bag 12, and the second zipper 42 opens an enclosure mouth 60 to allow the air mattress 14 to be inserted. The second zipper 42 is then resealed. It is also possible that the sleeping bag top layer 20 and bottom layer 22 are detachable from the enclosure bag 56, in order to allow it to be washed or removed for weight considerations.

Figure 3D:
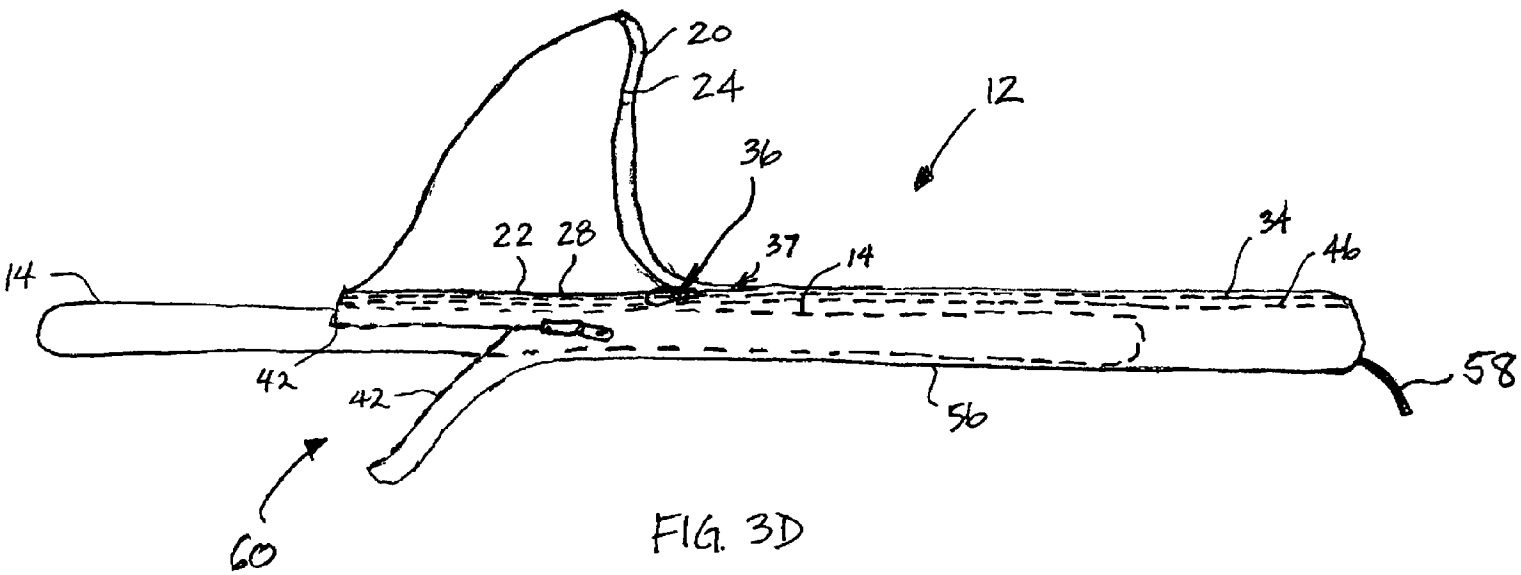
FIG. 3D is a side view of the second preferred embodiment of the sleeping bag with replaceable air mattress shown in FIGS. 3A-3C.
Figure 3E:
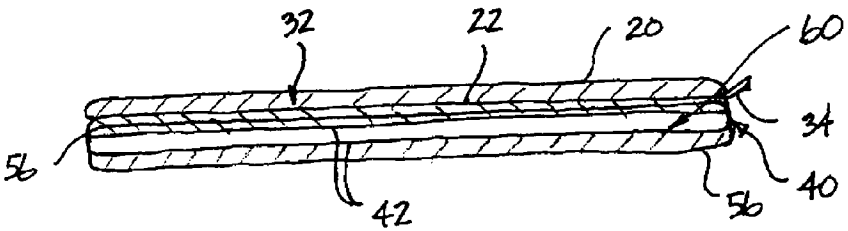
FIG. 3E is a front view of the second preferred embodiment of the sleeping bag with replaceable air mattress shown in FIGS. 3A-3C.

FIG. 3D is a side view of the second preferred embodiment 100 as shown in FIGS. 3A-3C, showing the air mattress 14 partially inserted into the enclosure mouth 60. FIG. 3E is a front view of the second preferred embodiment 100. The second zipper 42, as shown in FIG. 3E, is partially open and defines the enclosure mouth 60. As shown in FIG. 3E, the entry opening 32 is closed by the fastener 34.

There may also be optional elastic loops 58 which are used to retain the sleeping bag 100 in a rolled configuration. These may also be used with the first embodiment 10 described above.

While various embodiments have been described above, it should be understood that they have been presented by way of example only, and not limitation. Thus, the breadth and scope of a preferred embodiment should not be limited by any of the above described exemplary embodiments, but should be defined only in accordance with the following claims and their equivalents.

INDUSTRIAL APPLICABILITY

The present sleeping bag with replaceable air mattress 10 is well suited for application on camping trips and over-night outings.

The sleeping bag 12 includes a top layer 20 and a bottom layer 22. The top layer opening edge 24 and the bottom layer opening edge 28 are releasably fastened along some portion of their length by a first fastener 34 which is attached at a first attachment site 37. The bottom layer 22 further includes a second attachment site 38 for a upper portion 39 of a second fastener 40. The air mattress has a perimeter 15 and includes an inflatable portion 18 and a peripheral extension 16. The peripheral extension 16 includes a third attachment site 44 for a lower portion 41 of a second fastener 40. Upper 39 and lower portions 41 of the second fastener 40, preferably a zipper 42, releasably fasten the air mattress 14 to the sleeping bag 12.

In use, the air mattress 14 can be easily released from the sleeping bag, when it is necessary to replace it, or if it is to be used in situations where an air mattress is not required, as when the sleeping bag is being used more as a blanket, and bottom thermal isolation and cushion support are not necessary.

Since the attached air mattress 14 will provide thermal insulation from the ground, thermal material may not be needed in the bottom layer 22. Thus, it is possible to reduce the weight of the overall sleeping bag 10 by the weight of the omitted thermal layer which would otherwise be used in the bottom layer 22.

The industrial applicability of this invention is also enhanced because it is standard practice in manufacturing air mattresses that a bordering strip of material is included beyond the inflation area of the air mattress, and this bordering strip is usually trimmed off. However, for the present invention, this same bordering strip, denoted here as the peripheral extension 16 may be used as the third attachment site 44 for detachably fastening the air mattress 14 to the sleeping bag 12, and thus eliminating a fabrication step.

For the above, and other, reasons, it is expected that the sleeping bag with replaceable air mattress 10 of the present invention will have widespread industrial applicability. Therefore, it is expected that the commercial utility of the present invention will be extensive and long lasting.

What is claimed is:

1. A sleeping structure comprising:

a sleeping bag comprising:

a top layer having a top layer opening edge and a top layer sealed edge; and a bottom layer having a bottom layer opening edge and a bottom layer sealed edge;

a first fastener releasably fastening said top layer opening edge and said bottom layer opening edge at a first attachment site;

an enclosure bag defining a mouth;

a second fastener releasably fastening said enclosure bag to said sleeping bag; and an air mattress including an inflatable portion, said air mattress removably inserted into said mouth.

2. A sleeping structure in accordance with claim 1 wherein said second fastener releasably fastens said bottom layer to said enclosure bag.

3. A sleeping structure in accordance with claim 2 wherein said sleeping bag is detachable from said enclosure bag.

4. A sleeping structure in accordance with claim 1 further comprising a third fastener sealing said mouth such that said air mattress is contained within said mouth.

* * * * *